United States Patent [19]

Marzoli et al.

[11] Patent Number: 5,010,623

[45] Date of Patent: Apr. 30, 1991

[54] TEXTILE FIBRE MIXING APPARATUS

[76] Inventors: Pietro B. Marzoli; Emilio Vezzoli, both of Via Durante, 1, Palazzolo sull'Oglio (BS), Italy

[21] Appl. No.: 433,512

[22] Filed: Nov. 8, 1989

[30] Foreign Application Priority Data

Jun. 1, 1989 [IT] Italy ..... 20727/89[U]

[51] Int. Cl.[5] ..... D01G 13/00

[52] U.S. Cl. ..... 19/145.5

[58] Field of Search ..... 19/9, 80 R, 59, 300, 19/200, 303, 205, 304, 105, 107, 145.5, 50, 64.5, 150

[56] References Cited

U.S. PATENT DOCUMENTS

| | | | |
|---|---|---|---|
| Re. 31,802 | 1/1985 | Einglett et al. | 19/50 |
| 1,035,300 | 8/1912 | Ball et al. | 19/80 R |
| 1,708,826 | 4/1929 | Biglane | 19/59 |
| 2,133,900 | 10/1938 | Martinez | 19/59 |
| 3,142,869 | 8/1964 | Gould et al. | 19/205 |
| 3,834,869 | 9/1974 | Ancelle et al. | 19/300 |
| 4,301,573 | 11/1981 | Gunter et al. | 19/200 |
| 4,519,114 | 5/1985 | Rhyne | 19/205 |
| 4,531,262 | 7/1985 | Reiche | 19/145.5 |
| 4,686,744 | 9/1987 | Shofner | 19/105 |
| 4,736,493 | 4/1988 | Haass-Zöllick et al. | 19/205 |
| 4,866,815 | 9/1989 | Lucassen et al. | 19/205 |

*Primary Examiner*—Werner H. Schroeder
*Assistant Examiner*—John J. Calvert
*Attorney, Agent, or Firm*—Bucknam & Archer

[57] ABSTRACT

The mixer comprises cooperating devices for removing powder and not spinnable materials from a de-stapled textile material, and a plurality of adjoining vertical cells supplied with the fibre material to be processed and provided, at the bottom portions thereof, with rotary horizontal parallel toothed rollers, an opening cylinder being moreover arranged above these rollers cooperating with a grid communicating with a waste material collecting chamber, the cells opening, at the bottom portions thereof, on a horizontal channel for conveying the textile material to a further processing apparatus and being provided with means for removing not spinnable light material particles.

1 Claim, 2 Drawing Sheets

TEXTILE FIBRE MIXING APPARATUS

BACKGROUND OF THE INVENTION

The present invention relates to a mixing apparatus for mixing textile fibres and the like.

As is known, cotton staple fibres are closely mixed or blended by suitable mixing apparatus which are supplied with a given blend of said cotton staple fibres.

Prior mixing apparatus, however, simply carry out mixing or homogenizing operations on cotton fibres exclusively if these cotton fibres are of the same type or origin.

In this connection reference can be made to a mixing apparatus disclosed in the DE No. 3 713 590 Patent, in which, however, there are not provided means for properly cleaning the fibre material being blended.

Cotton staples, on the other hand, usually include powder and not spinnable material particles, which must be removed before the cotton staple processing operations, to prepare the cotton fibres for the end spinning operation.

Thus, further cleaning apparatus must be provided for properly cleaning the cotton material to be spun.

In this connection, there are indeed known textile material fibre cleaning devices which usually remove not spinnable particles from the textile fibres being processed by means of an air stream impinging against an elbow member which essentially consists of a grid.

In these devices, which are for example disclosed in the DE No. 30 06 831 Patent, the water material collecting chamber is however coupled, through an air recovering duct, to a main air duct for conveying cotton staples entrained by a main air flow.

Thus, the mentioned air recovering duct is susceptible to disadvantageously entrain a portion of the not spinnable material collected in the collecting chamber.

SUMMARY OF THE INVENTION

Accordingly, the main object of the present invention is to overcome the above mentioned drawbacks, by providing a textile fibre mixing apparatus which is adapted to simultaneously properly cleaning textile fibres being processed.

Another object of the present invention is to provide such a textile fibre mixing or blending apparatus in which the mentioned cleaning operation is carried out both during the staple opening step and during the staple conveying step, in which said staples are conveyed to further processing machines.

Another object of the invention is to provide such a mixing apparatus which is very reliable in operation.

According to one aspect of the present invention, the above mentioned objects, as well as yet other objects, which will become more apparatus hereinafter, are achieved by an improved mixing apparatus for mixing textile fibres, in particular cotton staple fibres, characterized in that said apparatus comprises a plurality of adjoining vertical cells which are supplied with the fibre material to be processed, at the bottom portions of said cells there being arranged two counter-rotating horizontal parallel rollers, a staple opening cylinder being moreover arranged under said rollers, adjoining a grid communicating with a not spinnable material collecting chamber, said cells opening, at a bottom portion thereof, on a horizontal channel for conveying textile must material to be processed to a further processing machine and being provided with means for removing settled particles therefrom.

BRIEF DESCRIPTION OF THE DRAWINGS

Further characteristics and advantages of the improved textile fibre mixing apparatus according to the present invention will become more apparent hereinafter from the following detailed description of a preferred embodiment threreof which is illustrated, by way of an indicative but not limitative example, in the figures of the accompanying drawings, in which.

DESCRIPTION OF THE PREFERRED EMBODIMENT

With reference to the drawings, the improved textile fibre mixing or blending apparatus according to the present invention comprises a plurality of cells 1, supplied with cotton staples removed from cotton bales and which can be possibly blended with technical fibres.

Inside said cells there are transversely arranged, on parallel horizontal axes, two toothed rollers 2 which are rotatively driven so as to grip the textile material to be processed and push it downward.

Under said rollers, a rotary cylinder 3 is arranged, also having a horizontal axis, which is provided with a helical tooth configuration or arrangement.

Figure 1:
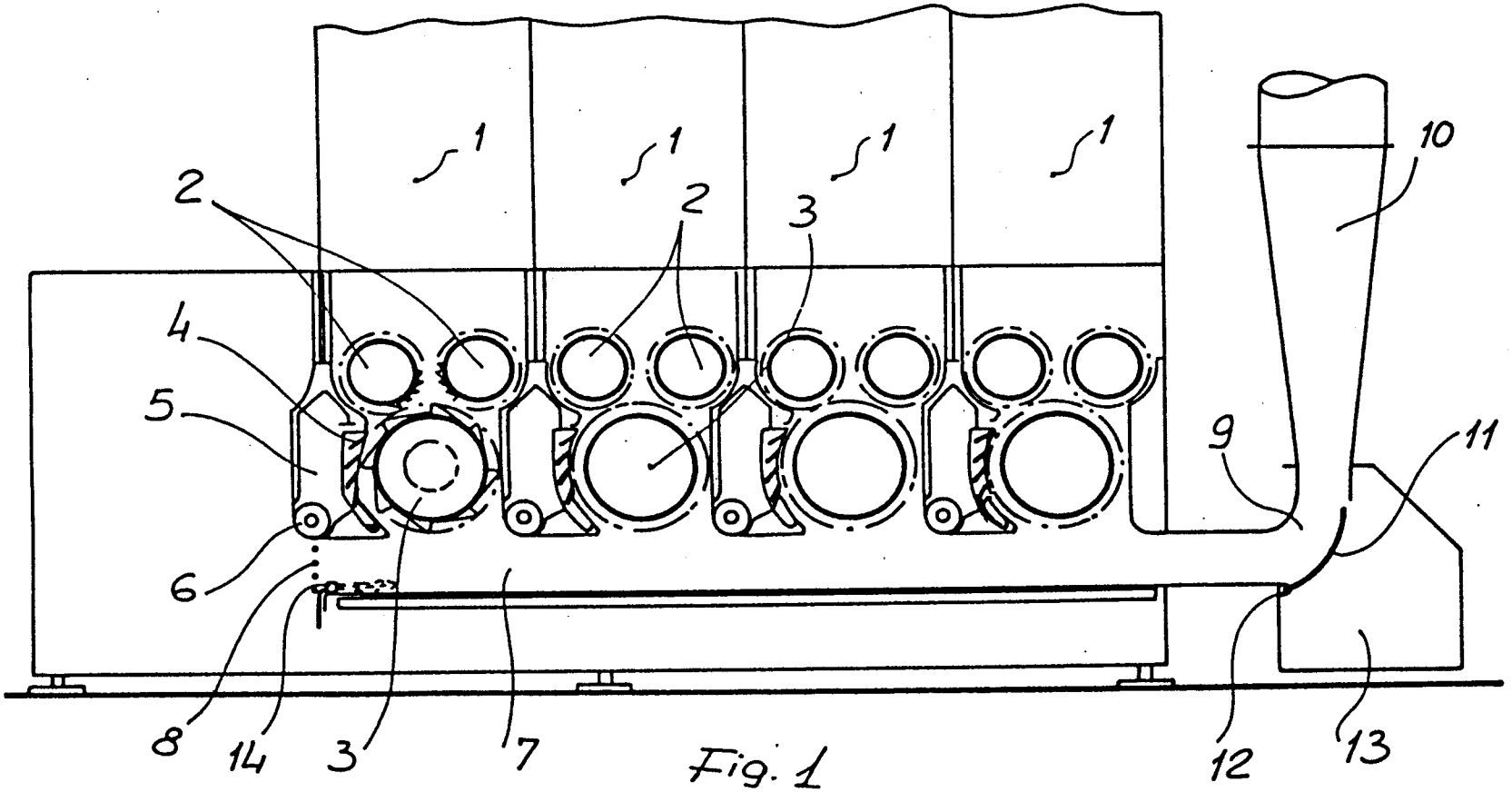
FIG. 1 is a schematic cross-section view illustrating the textile fibre mixing apparatus according to the present invention.
Figure 2:
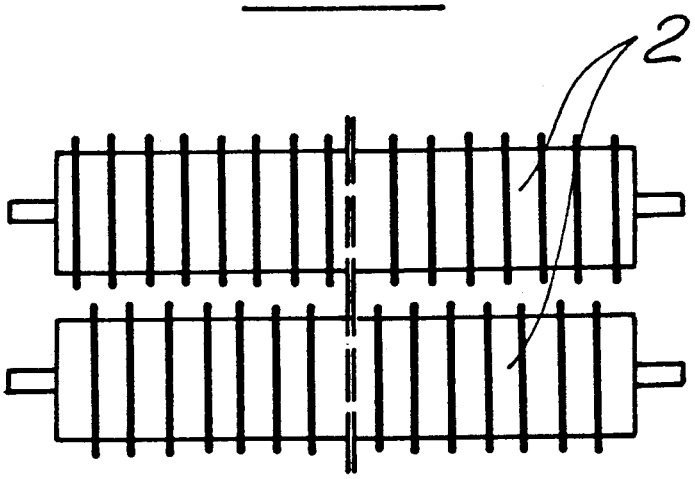
FIG. 2 shows a roller pair for supplying staple textile fibres to be processed, in particular cotton staple fibres.
Figure 3:
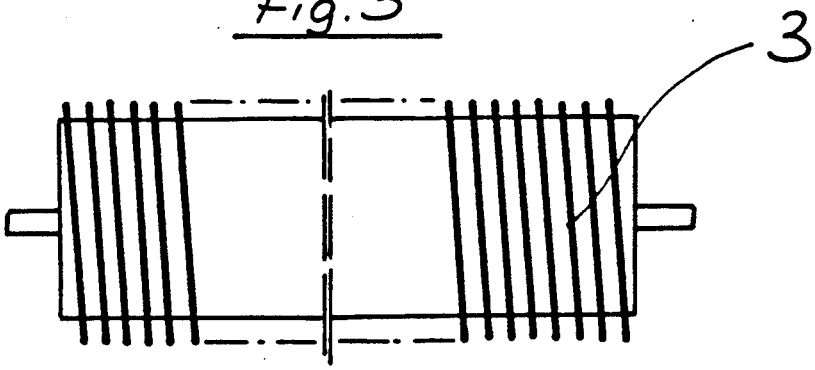
FIG. 3 shows an opening cylinder cooperating with the mentioned rollers.
Figure 4:
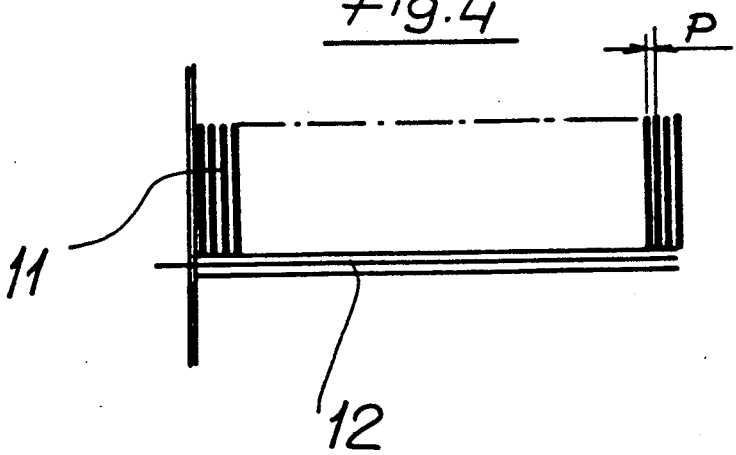
FIG. 4 shows a comb member arranged at one end portion of a channel for sucking and collecting fibre textile material.

This cylinder, in particular, has been specifically designed for engaging the cotton staples entrained or driven by the right (with reference to FIG. 1) roller, and partially opening the cotton staples which, as they are pushed against the left counter-rotating roller, will be further opened.

Adjoining said cylinder, and downstream of said rollers there is moreover provided a vertical ride grid 4 communicating with a waste material collecting chamber 5 provided with removing devices, such as a rotary worm screw 6, for removing not spinnable waste material.

More specifically, in operation the opened cotton staples will be entrained and pushed by the cylinder 3 against the grid 4 therethrough at least a portion of the not spinnable material included in the textile material being processed is caused to centrifugally pass.

The not spinnable material particles, in particular, are collected in said chamber 5 and are removed therefrom by means of the mentioned removing devices.

Under the cells 1 a horizontal channel is moreover arranged, indicated at the reference number 7 and having preferably a rectangular cross-section, said channel being closed, at one end thereof, by a vertical closing grid 8.

At the opposite end, the channel extends upward with a curved portion 9, through a suction duct 10 adapted to convey the fibre textile material to a further textile material processing apparatus.

In this connection it should be pointed out that said curved portion is defined, on the outside, by a comb member 11, which is correspondingly bent and has a pitch, between two adjoining teeth, indicated at P and included between 2 and 10 mm.

As shown, the mentioned comb member is pivoted, against the biassing of a coil spring, on a horizontal axis 12 and communicates the mentioned curved portion with a static negative pressure chamber 13.

Moreover, at the end portion of said channel 7 including said closing grid, there is provided a blowing device 14 provided for blowing air along the bottom of said channel.

Thus, the fibre textile material fed by said cylinder into said bottom channel will be conveyed, by suction, along the duct 10 to a further processing machine, since the downward arranged machine will generate a negative pressure in said duct, so as to displace air therein with a given flow rate.

Thus, the fibre material trajectory will be abruptely changed, at the elbow fitting 9, so as to impinge against the comb member 11, with a consequent inertial removal therefrom of further embedded not spinnable material.

In this connection it should be pointed out that a portion of this not spinnable material, not discharged through the grid 4, will be deposited, because of a less air drag, on the bottom of said channel 7.

At this time, the mentioned blowing device 14 will be actuated for suitably increasing the flow rate of the air stream generated downstream in said channel and of about 4–5 m/sec., thereby driving said particles settled on the bottom of the channel and conveying said particles by a substantially rectilinear horizontal movement to the collecting chamber 13.

While the invention has been disclosed and illustrated with reference to a preferred embodiment thereof, it should be apparent that the disclosed embodiment is susceptible to several variations and modifications within the spirit and scope of the claims.

What is claimed is:

1. A mixing apparatus for mixing textile fibres, in particular cotton staple fibres, comprising a plurality of adjoining vertical cells supplied with a fibre material to be processed, two counter-rotating horizontal parallel rollers arranged at bottom portions of said cells, a staple opening cylinder arranged under said rollers, a vertical grid adjoining said cylinder and communicating with a not spinnable material collecting chamber, said collecting chamber including a rotary worm screw for removing not spinnable waste material, said cells opening, at said bottom portion thereof, on a horizontal rectangular cross-section channel for conveying textile material to be processed to a further processing machine and being provided with means for removing settled particles from said channel, said channel being closed at one end thereof by a closing grid, said channel extending at an opposite end thereof with an upward curved portion and a fibre material suction duct for conveying said material to said further processing machine, said upward curved portion of said channel being defined by a comb member correspondingly curved and operating as a gate member, said comb member having teeth spaced with a pitch from 2 to 10 mm and being pivoted, against a coil spring, on a horizontal axis so as to communicate said curved portion with a static negative pressure chamber, said channel further comprising, near said closing grid, an air blowing device which is so controlled as to increase a suction air flow rate.

* * * * *